US007878875B2

(12) United States Patent
Uriu et al.

(10) Patent No.: US 7,878,875 B2
(45) Date of Patent: Feb. 1, 2011

(54) PLASMA DISPLAY PANEL WITH DISPLAY ELECTRODES CONTAINING GLASS FRIT AND A METHOD OF MANUFACTURING THE SAME

(75) Inventors: Eiichi Uriu, Osaka (JP); Akira Kawase, Osaka (JP); Kazuhiro Morioka, Kyoto (JP); Tatsuo Mifune, Osaka (JP)

(73) Assignee: Panasonic Corporation, Osaka (JP)

( * ) Notice: Subject to any disclaimer, the term of this patent is extended or adjusted under 35 U.S.C. 154(b) by 492 days.

(21) Appl. No.: 11/911,920

(22) PCT Filed: Feb. 26, 2007

(86) PCT No.: PCT/JP2007/053472

§ 371 (c)(1),
(2), (4) Date: Oct. 18, 2007

(87) PCT Pub. No.: WO2007/105467

PCT Pub. Date: Sep. 20, 2007

(65) Prior Publication Data

US 2009/0021171 A1 Jan. 22, 2009

(30) Foreign Application Priority Data

Feb. 28, 2006 (JP) ..... 2006-051737

(51) Int. Cl.
*H01J 9/00* (2006.01)
*H01J 9/24* (2006.01)
*H01J 17/49* (2006.01)

(52) U.S. Cl. ..... 445/24; 313/582; 313/586; 445/46; 428/426; 428/427

(58) Field of Classification Search ..... 313/582–587; 445/24
See application file for complete search history.

(56) References Cited

U.S. PATENT DOCUMENTS 6,159,066 A * 12/2000 Amatsu et al. ..... 445/24

(Continued)

FOREIGN PATENT DOCUMENTS

EP 0 788 131 8/1997

(Continued)

OTHER PUBLICATIONS

International Search Report dated Jun. 5, 2007 issued in the International Application No. PCT/JP2007/053472.

(Continued)

*Primary Examiner*—Sikha Roy
(74) *Attorney, Agent, or Firm*—Wenderoth, Lind & Ponack, L.L.P.

(57) ABSTRACT

The PDP has a front panel, and a back panel with address electrodes formed thereon. The front panel has display electrodes including first electrodes and second electrodes formed on front glass substrate, and a dielectric layer covering the display electrodes. Further, first electrodes and the dielectric layer include glass frit containing bismuth oxide, with a softening point exceeding 550° C. The glass frit contained in the second electrodes has a softening point lower than that contained in the first electrodes. The above-described configuration reduces the number of firing steps for display electrodes and the dielectric layer, thereby providing a PDP with improved production efficiency and a method of manufacturing the PDP.

2 Claims, 4 Drawing Sheets

U.S. PATENT DOCUMENTS

| | | | | |
|---|---|---|---|---|
| 6,207,268 | B1 * | 3/2001 | Kosaka et al. | 428/325 |
| 6,787,239 | B2 * | 9/2004 | Fujii et al. | 428/427 |
| 6,850,007 | B2 * | 2/2005 | Shinoda et al. | 313/587 |
| 7,718,281 | B2 * | 5/2010 | Miyazaki et al. | 428/701 |
| 2003/0108753 | A1 | 6/2003 | Fujii et al. | |
| 2004/0047981 | A1 | 3/2004 | Ebe et al. | |
| 2004/0259452 | A1 * | 12/2004 | Matsumoto et al. | 445/24 |
| 2005/0242725 | A1 | 11/2005 | Hasegawa et al. | |

FOREIGN PATENT DOCUMENTS

| | | |
|---|---|---|
| JP | 9-50769 | 2/1997 |
| JP | 2000-48645 | 2/2000 |
| JP | 2002-25451 | 1/2002 |
| JP | 2002-53342 | 2/2002 |
| JP | 2003-128430 | 5/2003 |
| JP | 2003-208852 | 7/2003 |
| JP | 2003-226549 | 8/2003 |
| JP | 2004-95355 | 3/2004 |
| JP | 2005-317247 | 11/2005 |
| JP | 2005-332599 | 12/2005 |
| JP | 2005-336048 | 12/2005 |

OTHER PUBLICATIONS

European Patent Office Search Report issued Jun. 16, 2010 in corresponding European Application No. 07 71 4904.

* cited by examiner

PLASMA DISPLAY PANEL WITH DISPLAY ELECTRODES CONTAINING GLASS FRIT AND A METHOD OF MANUFACTURING THE SAME

This Application is a U.S. National Phase Application of PCT International Application PCT/JP2007/053472.

BACKGROUND OF THE INVENTION

1. Technical Field

The present invention relates to a plasma display panel used, for example, as a display device, and to a method of manufacturing the plasma display panel.

2. Description of the Related Art

A plasma display panel (referred to as PDP hereinafter), with its possibility of finer resolution and larger screen size, is used to commercialize such as a 65-inch class television set. In recent years, a PDP has been applied to so-called "full-spec" high-definition TV, with the number of scanning lines twice that of a display device with conventional NTSC method. In addition, a lead-free PDP is demanded to deal with environmental issues.

A PDP is basically composed of a front panel and a back panel.

The front panel has a glass substrate made of sodium borosilicate based glass produced by float process. The front panel further has display electrodes, a dielectric layer, and a protective layer, each formed on one main surface of the glass substrate. A display electrode is composed of striped transparent electrodes and bus electrodes. The dielectric layer, covering the display electrodes, works as a capacitor. The protective layer, made of magnesium oxide (MgO), is formed on the dielectric layer. A bus electrode is composed of a first electrode for reducing the connection resistance and a second electrode for blocking light.

The back panel has a glass substrate; and address electrodes, a base dielectric layer, barrier ribs, and a phosphor layer, each formed on one main surface of the glass substrate. The address electrodes are striped. The base dielectric layer covers the address electrodes. The barrier ribs are formed on the base dielectric layer. The phosphor layer, formed between respective barrier ribs, is composed of red, green, and blue phosphor layers, emitting red, green, and blue light, respectively.

The front panel and back panel are arranged so that the surfaces with the electrodes formed thereon mutually face each other, and are sealed airtight. Further, an Ne—Xe discharge gas is encapsulated in a discharge space partitioned by the barrier ribs, at a pressure of 400 Torr to 600 Torr.

The PDP discharges with an image signal voltage selectively applied to some display electrodes. Ultraviolet light generated with discharge excites each color phosphor layer. Consequently, the PDP emits red, green, and blue light to display a color image.

A bus electrode contains silver to ensure conductivity. The dielectric layer conventionally contains glass frit with a low melting point containing lead oxide as the principal component. However, a PDP containing lead-free glass frit to deal with environmental issues of recent years is disclosed in such as Japanese Patent Unexamined Publication No. 2003-128430 (JP '430), No. 2002-053342 (JP '342), and No. H09-050769 (JP '769).

For glass frit used when forming bus electrodes, a PDP containing bismuth oxide instead of lead is disclosed in such as Japanese Patent Unexamined Publication No. 2000-048645 (JP '645).

SUMMARY OF THE INVENTION

The present invention provides a PDP with high production efficiency even if lead-free paste material of glass frit is used, and a method of manufacturing the PDP.

A PDP of the present invention has a front panel, and a back panel with address electrodes formed thereon. The front panel has display electrodes having first electrodes and second electrodes formed on the front glass substrate, and a dielectric layer covering the display electrodes. The first electrodes and the dielectric layer include glass frit, which contains bismuth oxide with a softening point exceeding 550° C., where the glass frit contained in the second electrodes has a softening point lower than that in the first electrodes. The above-described configuration allows the number of firing steps for the display electrodes and the dielectric layer to be reduced, thereby providing a PDP with improved production efficiency and a method of manufacturing the PDP.

DETAILED DESCRIPTION OF PREFERRED EMBODIMENT

Hereinafter, a description is made for a PDP according to an embodiment of the present invention, using the related drawings.

Exemplary Embodiment

Figure 1:
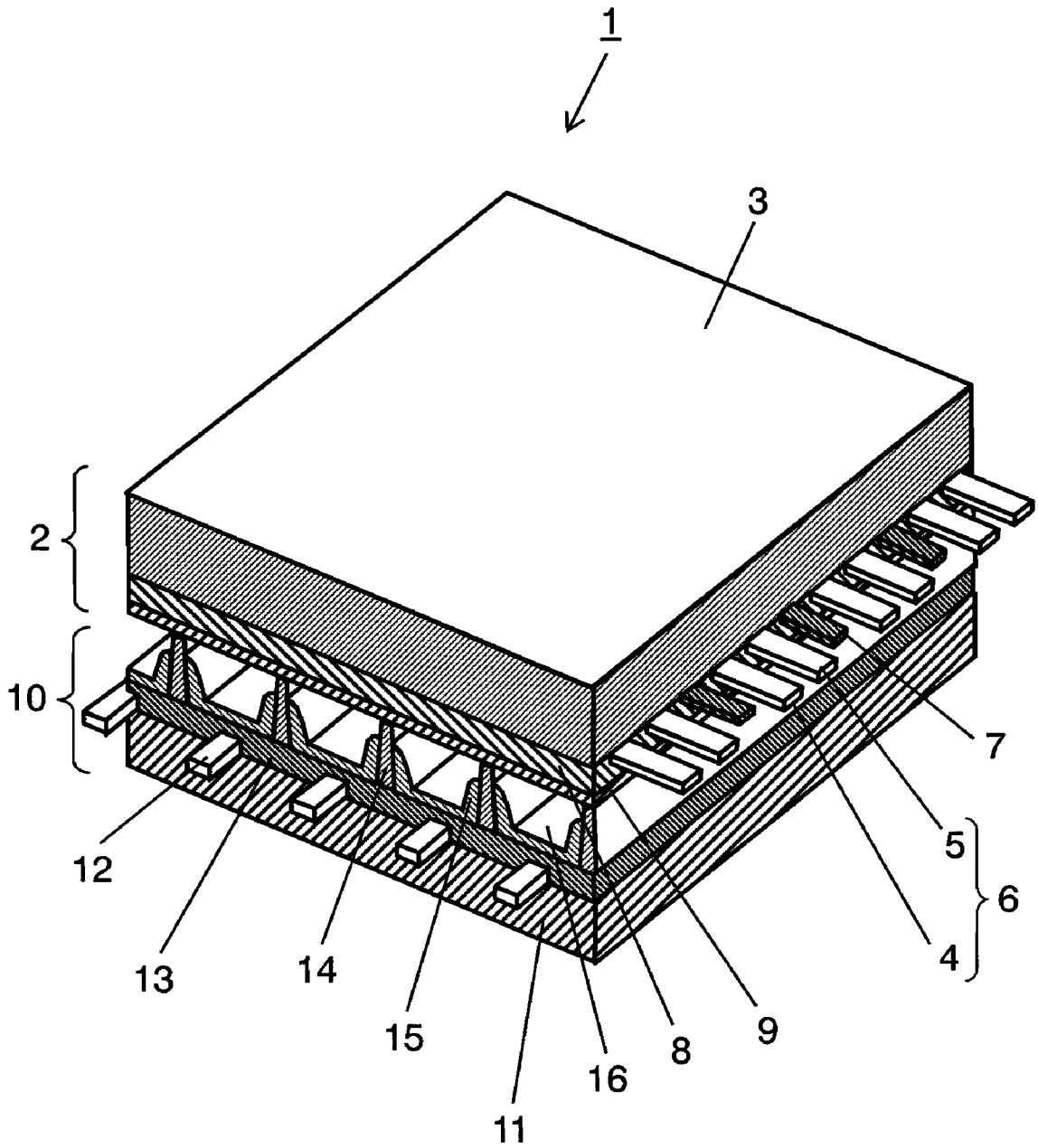
FIG. 1 is a perspective view illustrating the structure of a PDP according to an embodiment of the present invention.

FIG. 1 is a perspective view illustrating the structure of a PDP according to an embodiment of the present invention. The basic structure of the PDP is of general AC surface-discharge type. As shown in FIG. 1, plasma display panel 1 (referred to as PDP 1 hereinafter) has front panel 2 and back panel 10 facing each other, where the outer circumferences of front panel 2 and back panel 10 are sealed airtight with a sealant (not shown) made of glass frit or the like. This structure forms discharge space 16 inside PDP 1. Further, a discharge gas such as Ne or Xe is encapsulated in discharge space 16 at a pressure of 400 Torr to 600 Torr.

Front panel 2 has front glass substrate 3; and display electrodes 6, black stripe 7 as a light blocking layer, dielectric layer 8, and protective layer 9, each formed on front glass substrate 3. Display electrodes 6 are strip-shaped with each pair of scan electrodes 4 and sustain electrodes 5 arranged parallel to each other. Further, a plural series of display electrodes 6 and black stripe 7 are respectively arranged parallel to each other. Dielectric layer 8 is formed so as to cover display electrodes 6 and black stripe 7 to work as a capacitor. Protective layer 9, made of magnesium oxide (MgO) or the like, is formed on the surface of dielectric layer 8.

Back panel 10 has back glass substrate 11; and address electrodes 12, base dielectric layer 13, barrier ribs 14, and phosphor layer 15, each formed on back glass substrate 11. Plural strip-shaped address electrodes 12 are formed orthogonally to scan electrodes 4 and sustain electrodes 5, and arranged parallel to each other. Base dielectric layer 13 covers address electrodes 12. Barrier ribs 14, having a given height, are formed on base dielectric layer 13 between address electrodes 12 to partition discharge space 16. Phosphor layer 15 is formed in the grooves between barrier ribs 14 corresponding to each address electrode 12. Phosphor layer 15 is formed by sequentially applying phosphor layers respectively emitting red, blue, or green light, caused by ultraviolet light. A discharge cell is formed where scan electrode 4, sustain electrode 5, and address electrode 12 cross. A discharge cell having phosphor layers 15 for red, blue, and green, arranged in the direction of display electrodes 6 becomes a pixel for color display.

Figure 2:
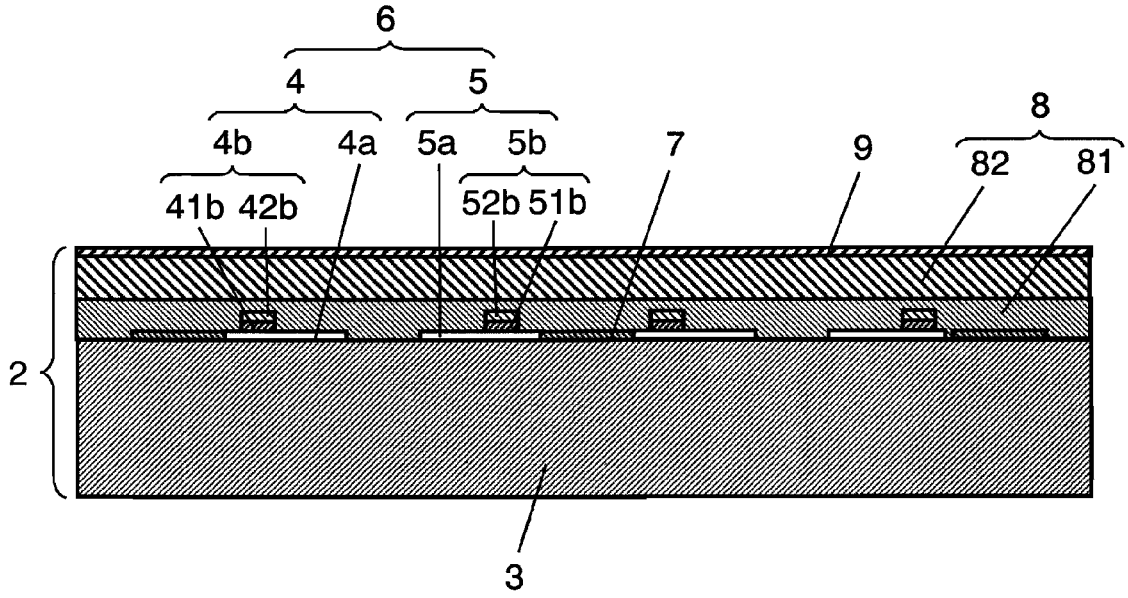
FIG. 2 is a sectional view illustrating the makeup of the front panel used for the PDP shown in FIG. 1.

FIG. 2 is a sectional view illustrating the structure of front panel 2 used for PDP 1 shown in FIG. 1. FIG. 2 shows the image of FIG. 1 vertically inverted. As shown in FIG. 2, front glass substrate 3, produced by float process or the like, has display electrodes 6 and black stripe 7 pattern-formed thereon.

Scan electrode 4 and sustain electrode 5 are composed of transparent electrode 4*a*, 5*a*; and bus electrode 4*b*, 5*b* formed on transparent electrode 4*a*, 5*a*, respectively. Transparent electrodes 4*a*, 5*a* are made of material such as indium oxide (ITO) or tin oxide ($SnO_2$). Bus electrode 4*b*, 5*b* is formed to exert conductivity in the longitudinal direction of transparent electrode 4*a*, 5*a*, with conductive material primarily containing silver (Ag). Further, bus electrode 4*b*, 5*b* is composed of white first electrode 42*b*, 52*b* for reducing the electrical resistance; and black second electrode 41*b*, 51*b* for blocking outside light, respectively.

Dielectric layer 8 is provided so as to cover transparent electrodes 4*a*, 5*a*, bus electrodes 4*b*, 5*b*, and black stripe 7. Further, dielectric layer 8 has at least two layers (i.e. first dielectric layer 81, and second dielectric layer 82 formed on first dielectric layer 81). Second dielectric layer 82 has protective layer 9 formed thereon.

Figure 3:
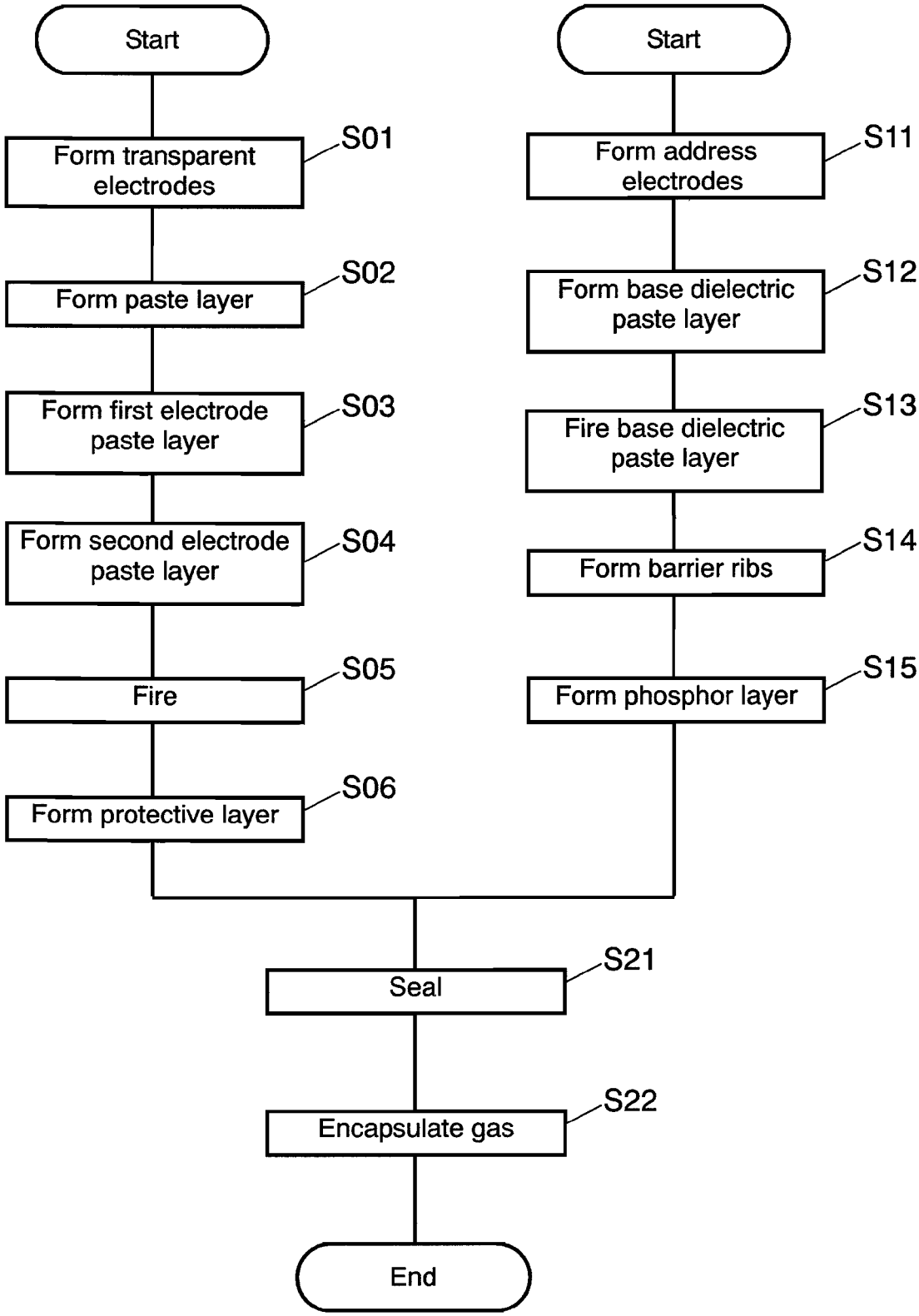
FIG. 3 is a flowchart illustrating a method of manufacturing the PDP shown in FIG. 1.
Figure 4:
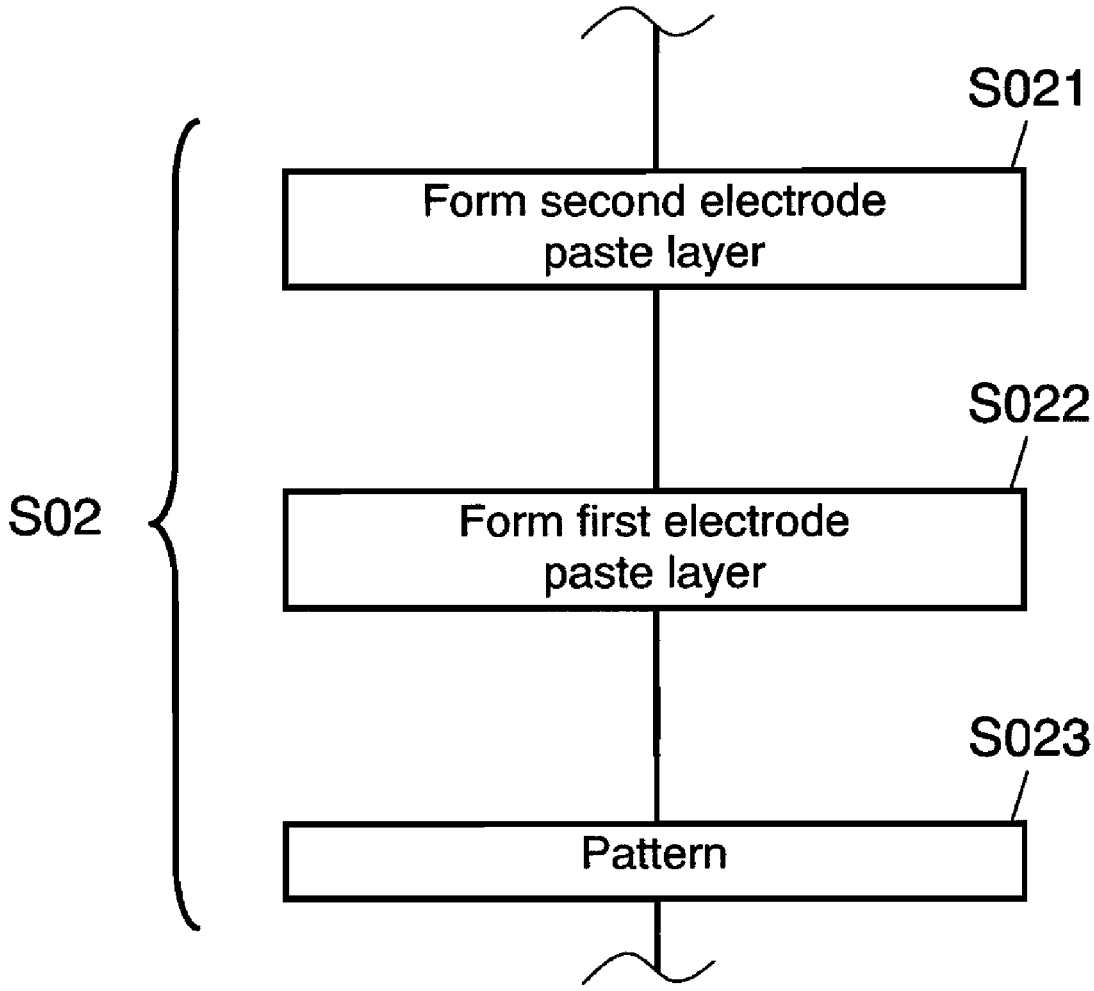
FIG. 4 is a flowchart illustrating a part of the method of manufacturing the PDP shown in FIG. 1.

Next, a description is made for a method of manufacturing PDP 1, using FIGS. 3, 4.

FIG. 3 is a flowchart illustrating a method of manufacturing the PDP shown in FIG. 1. FIG. 4 is a flowchart illustrating the details about the paste layer forming step of the method of manufacturing the PDP shown in FIG. 1.

Front panel 2 is produced in the following steps.

First, transparent electrodes 4*a*, 5*a*, partially composing scan electrode 4 and sustain electrode 5, are pattern-formed on front glass substrate 3 by patterning using photolithography or the like (S01: transparent electrode forming step).

Next, a paste layer to be black stripe 7 and that to be bus electrodes 4*b*, 5*b* are formed respectively by photolithography, screen printing, or the like (S02: paste layer forming step). Here, a paste layer to be bus electrodes 4*b*, 5*b* is formed on transparent electrodes 4*a*, 5*a*. A paste layer to be bus electrodes 4*b*, 5*b* includes a second electrode paste layer containing conductive black particles; and a first electrode paste layer containing silver material. A paste layer to be black stripe 7 is as well made of paste material containing black pigment.

Next, a first dielectric paste layer to be first dielectric layer 81 is formed by applying the first dielectric paste by die coating so as to cover the paste layer to be bus electrodes 4*b*, 5*b* and that to be black stripe 7, respectively (S03: first dielectric paste layer forming step). Here, as a result that the first dielectric paste layer is left standing for a given time after the first dielectric paste is applied, the applied surface of the first dielectric paste layer is leveled to become flat.

Next, a second dielectric paste layer to be second dielectric layer 82 is formed by applying the second dielectric paste by die coating so as to cover the first dielectric paste layer (S04: second dielectric paste layer forming step).

Next, the paste layer to be bus electrode 4*b*, 5*b*; the paste layer to be black stripe 7; the first dielectric paste layer; and the second dielectric paste layer are collectively fired (S05: firing step). Undergoing the firing step (S05) forms scan electrodes 4, sustain electrodes 5, black stripe 7, first dielectric layer 81, second dielectric layer 82. Here, the first and second dielectric pastes are coating material containing powdered dielectric glass frit, a binder, and solvent.

Next, protective layer 9 made of magnesium oxide is formed on dielectric layer 8 by vacuum evaporation method (S06: protective layer forming step).

Undergoing each step described above forms predetermined constructional elements on front glass substrate 3 to produce front panel 2.

Back panel 10 is produced in the following steps.

First, address electrodes 12 are formed on back glass substrate 11 (S11: address electrode forming step). Here, address electrodes 12 are formed as a result that a material layer to be address electrodes 12 is formed on back glass substrate 11, and that the material layer formed is fired at a given temperature. The material layer to be address electrodes 12 is formed by a method such as where a paste containing silver material is screen-printed, or patterned by photolithography after a metal film is formed on the whole surface.

Next, a base dielectric paste is applied by die coating or the like so as to cover address electrodes 12 to form a base dielectric paste layer to be base dielectric layer 13 (S12: base dielectric paste layer forming step). Here, as a result that the dielectric paste layer is left standing for a given time after the base dielectric paste is applied, the applied surface of the dielectric paste layer is leveled to become flat. The base dielectric paste is coating material containing powdered dielectric glass frit, a binder, and solvent.

Next, firing the base dielectric paste layer forms base dielectric layer 13 (S13: base dielectric paste layer firing step).

Next, a barrier rib forming paste containing barrier rib material is applied on base dielectric layer 13, and patterned into a given shape to form a barrier rib material layer. After that, firing the barrier rib material layer forms barrier ribs 14 (S14: barrier rib forming step). Here, a method such as photolithography or sandblasting is used to pattern the barrier rib forming paste applied on base dielectric layer 13.

Next, a phosphor paste containing phosphor material is applied on base dielectric layer 13 between adjacent barrier ribs 14 and on the sides of barrier ribs 14. Then, firing the phosphor paste forms phosphor layer 15 (S15: phosphor layer forming step).

Undergoing each step described above produces back panel 10 with given constructional elements formed on back glass substrate 11.

As described above, front panel 2 and back panel 10, respectively produced, are arranged facing each other so that display electrodes 6 and address electrodes 12 are orthogonalized, and the peripheries of front panel 2 and back panel 10 are sealed with a sealant (S21: seal step). Consequently, discharge space 16 partitioned by barrier ribs 14 is formed in the space between front panel 2 and back panel 10 mutually facing.

Next, encapsulating a discharge gas containing a noble gas such as neon or xenon in discharge space 16 produces PDP 1 (S22: gas encapsulating step).

Next, further details are described about display electrodes 6 and dielectric layer 8, both provided on front panel 2.

Display electrode 6 is formed by sequentially laminating transparent electrode 4*a*, 5*a*; second electrode 41*b*, 51*b*; and first electrode 42*b*, 52*b*, on front glass substrate 3. First, after indium oxide with a thickness of approximately 0.12 μm is formed on the whole surface of front glass substrate 3 by sputtering, transparent electrodes 4*a*, 5*a*, striped with a width of 150 μm are formed by photolithography (S01: transparent electrode forming step).

Next, a second electrode paste to be second electrode 41*b*, 51*b* is applied on the whole surface of front glass substrate 3, by printing method or the like to form a second electrode paste layer (S021: second electrode paste layer forming step). Here, the second electrode paste layer becomes second electrodes 41*b*, 51*b* and black stripe 7 by being patterned and fired The second electrode paste contains conductive black particles of 70 wt % to 90 wt %, second glass frit of 1 wt % to 15 wt %, and a photosensitive organic binder component of 8 wt % to 15 wt %. The conductive black particles are at least one kind of black metal microparticles selected from the group of Fe, Co, Ni, Mn, Ru, and Rh; or metal oxide microparticles containing these black metals. The photosensitive organic binder component contains photosensitive polymer, photosensitive monomer, a light polymerization initiator, solvent, and others. The second glass frit contains at least bismuth oxide ($Bi_2O_3$) of 20 wt % to 50 wt % and has a softening point lower than that of the first glass frit contained in the first electrode paste.

Here, a paste layer to be black stripe 7 may be formed with material different from that of the second electrode paste layer to be second electrodes 41*b*, 51*b*, and by a different method. However, using the second electrode paste layer as a paste layer to be black stripe 7 dispenses with the step of independently providing black stripe 7, thereby improving the production efficiency.

Next, the first electrode paste is applied on the second electrode paste layer by printing method or the like, to form a first electrode paste layer (S022: first electrode paste layer forming step).

Here, the first electrode paste contains at least silver particles of 70 wt % to 90 wt %, first glass frit of 1 wt % to 15 wt %, and photosensitive organic binder component of 8 wt % to 15 wt %. The photosensitive organic binder component contains photosensitive polymer, photosensitive monomer, a light polymerization initiator, solvent, and others. The first glass frit contains at least bismuth oxide ($Bi_2O_3$) of 20 wt % to 50 wt % and has a softening point exceeding 550° C. The softening point of the first glass frit is preferably higher than 550° C. and lower than 600 ° C.

Next, the second and first electrode paste layers applied on the whole surface of front glass substrate 3 are patterned by photolithography or the like (S023: patterning step). Firing the second electrode paste layer after being patterned produces second electrodes 41*b*, 51*b* and black stripe 7. Firing the first electrode paste layer after being patterned as well produces first electrodes 42*b*, 52*b*.

Here, the second glass frit used for the second electrode paste layer and the first glass frit used for the first electrode paste layer contain bismuth oxide ($Bi_2O_3$) of 20 wt % to 50 wt %. The first and second glass frit are glass material containing, in addition to bismuth oxide, boron oxide ($B_2O_3$) of 15 wt % to 35 wt %, silicon oxide ($SiO_2$) of 2 wt % to 15 wt %, aluminium oxide ($Al_2O_3$) of 0.3 wt % to 4.4 wt %, and others. As a result that the constituent ratios of the materials of the second glass frit for the second electrode paste layer and the first glass frit for the first electrode paste layer are respectively changed, the softening points of the respective glass frit are adjusted.

Next, sequentially laminating first dielectric layer 81 and second dielectric layer 82 forms dielectric layer 8.

First, a first dielectric paste is applied on front glass substrate 3 by die coating or screen printing so as to cover the second and first electrode paste layers. Drying the first dielectric paste after being applied forms a first dielectric paste layer (S03: first dielectric paste layer forming step).

The first dielectric glass material contained in first dielectric layer 81 may be the same material as that of the first glass frit used for the first electrode paste layer. More specifically, the first dielectric glass material may contain bismuth oxide ($Bi_2O_3$) of 20 wt % to 50 wt %, boron oxide ($B_2O_3$) of 15 wt % to 35 wt %, silicon oxide ($SiO_2$) of 2 wt % to 15 wt %, aluminium oxide ($Al_2O_3$) of 0.3 wt % to 4.4 wt %.

The first dielectric glass material with the composition is crushed so as to be 0.5 μm to 2.5 μm in average particle diameter using a wet jet mill or ball mill to produce first dielectric glass frit. Next, the first dielectric glass frit of 55 wt % to 70 wt % and a binder component of 30 wt % to 45 wt % are kneaded using a triple roll mill to produce a first dielectric paste for die coating or printing. Here, the binder component contained in the first dielectric paste is terpineol or butyl carbitol acetate, containing ethyl cellulose or acrylic resin of 1 wt % to 20 wt %. A plasticizer, dispersant, or the like may be added into the first dielectric paste as required to improve the print quality. A plasticizer to be added includes di-octyl phthalate, di-butyl phthalate, triphenyl phosphate, or tributyl phosphate, for example. A dispersant to be added includes glycerol monooleate, sorbitan sesquioleate, Homogenol (registered trademark of Kao Corporation), or alkylallylic phosphate ester, for example.

Next, a second dielectric paste is applied on the first dielectric paste layer by screen printing or die coating. Drying the second dielectric paste after being applied forms a second dielectric paste layer (S04: second dielectric paste layer forming step).

The second dielectric glass material contained in second dielectric layer 82 contains bismuth oxide ($Bi_2O_3$) of 11 wt % to 20 wt %, zinc oxide (ZnO) of 26.1 wt % to 39.3 wt %, boron oxide ($B_2O_3$) of 23 wt % to 32.2 wt %, silicon oxide ($SiO_2$) of 1 wt % to 3.8 wt %, and aluminium oxide ($Al_2O_3$) of 0.1 wt % to 10.2 wt %. The second dielectric glass material further contains at least one kind of material selected from calcium oxide (CaO), strontium oxide (SrO), or barium oxide (BaO), of 9.7 wt % to 29.4 wt %, and cerium oxide (CeO2) of 0.1 wt % to 5 wt %.

The dielectric glass material with the composition is crushed so as to be 0.5 μm to 2.5 μm in average particle diameter using a wet jet mill or ball mill to produce second dielectric glass frit. Next, the second dielectric glass frit of 55 wt % to 70 wt % and a binder component of 30 wt % to 45 wt % are kneaded using a triple roll mill to produce a second dielectric paste for die coating or printing. Here, the binder component contained in the second dielectric paste is terpineol or butyl carbitol acetate, containing ethyl cellulose or acrylic resin of 1 wt % to 20 wt %. A plasticizer, dispersant, or the like may be added into the second dielectric paste as required to improve the print quality. A plasticizer to be added includes di-octyl phthalate, di-butyl phthalate, triphenyl phosphate, or tributyl phosphate, for example. A dispersant to be added includes glycerol monooleate, sorbitan sesquioleate, Homogenol (registered trademark of Kao Corporation), or alkylallylic phosphate ester, for example.

Then, the second electrode paste layer, first electrode paste layer, first dielectric paste layer, and second dielectric paste layer are collectively fired at 550° C. to 600° C. (S05: firing step). Here, the second electrode paste layer doubles as a paste layer to be black stripe 7, and thus the paste layer to be black stripe 7 is collectively fired as well at 550° C. to 600° C. in the firing step (S05). The process forms second electrodes 41*b*, 51*b*; first electrodes 42*b*, 52*b*; black stripe 7; first dielectric layer 81; and second dielectric layer 82. Here, black stripe 7, formed to block light, improves the contrast performance. However, black stripe 7 is not necessarily essential and PDP 1 without black stripe 7 is feasible as well.

In a conventional PDP, glass frit with a low softening point (450° C. to 550° C.) is used, where the firing temperature is 550° C. to 600° C. That is, the firing temperature is approximately 100° C. higher than the softening point of the glass frit. Accordingly, the bismuth oxide itself, with a high reactivity, contained in the glass frit reacts vigorously with silver and black metal microparticles, or with an organic binder component contained in the paste, to generate bubbles in bus electrodes 4*b*, 5*b* and dielectric layer 8, thereby deteriorating the dielectric strength of dielectric layer 8 in some cases.

However, for PDP 1 of the present invention, the softening point of the first glass frit exceeds 550° C., and the firing temperature is 550° C. to 600° C. That is, the softening point of the glass frit is close to the firing temperature, thus depressing the reaction of silver and black metal microparticles, or an organic component, with bismuth oxide. This decreases bubbles occurring in bus electrodes 4*b*, 5*b* and dielectric layer 8. Meanwhile, a softening point of the glass frit higher than 600° C. tends to depress the adhesiveness of bus electrodes 4*b*, 5*b* with transparent electrodes 4*a*, 5*a*, front glass substrate 3, or dielectric layer 8. Accordingly, the softening point of the first glass frit is preferably higher than 550° C. and lower than 600° C.

The film thickness of dielectric layer 8, including first dielectric layer 81 and second dielectric layer 82, is preferably smaller than 41 μm to ensure the transmittance of visible light. First dielectric layer 81 contains bismuth oxide of 20 wt % to 50 wt %, which is more than the second dielectric layer 82 contains, to suppress the reaction with silver contained in bus electrodes 4*b*, 5*b*. Accordingly, the visible-light transmittance of first dielectric layer 81 is lower than that of second dielectric layer 82. The film thickness of first dielectric layer 81 is thus thinner than that of second dielectric layer 82, thereby ensuring the transmittance of visible light transmitting through dielectric layer 8.

Second dielectric layer 82 containing bismuth oxide of less than 11 wt % is resistant to coloring, while bubbles are subject to occurring in second dielectric layer 82. Meanwhile, if the percentage of bismuth oxide content exceeds 20 wt %, coloring tends to occur, making difficult to increase the transmittance. Consequently, the percentage of bismuth oxide content in the second dielectric paste is preferably 11 wt % to 20 wt %.

As the film thickness of dielectric layer 8 becomes thinner, the panel luminance is improved and the discharge voltage is decreased more prominently. Accordingly, the film thickness of dielectric layer 8 is desirably thinnest possible as long as the dielectric strength does not decrease. From such a viewpoint, the film thickness of dielectric layer 8 is set to 41 μm or thinner; first dielectric layer 81, 5 μm to 15 μm; and second dielectric layer 82, 20 μm to 36 μm, in the embodiment of the present invention.

In this way, PDP 1, in spite of the fact that lead-free glass frit is used, bus electrodes 4*b*, 5*b*, black stripe 7, and dielectric layer 8 can be collectively fired. This can improve the production efficiency of PDP 1. Further, first electrodes 42*b*, 52*b* contain first glass frit with the same material composition as that of first dielectric layer 81, and thus heat stress is unlikely to occur at the boundary between first electrodes 42*b*, 52*b* and dielectric layer 8 when fired and solidified. This exerts a great adhesive effect between first electrodes 42*b*, 52*b* and dielectric layer 8, thus providing highly reliable PDP 1.

As described above, a plasma display panel of the present invention improves the production efficiency and is useful for a large-screen display device and the like.

The invention claimed is:

1. A method of manufacturing a plasma display panel, the plasma display panel having:

a front glass substrate;

a front panel including:

a display electrode including:

a first electrode formed on the front glass substrate, and containing silver; and a second electrode formed under the first electrode;

a dielectric layer covering the display electrode; and a back panel including a back glass substrate and an address electrode formed on the back glass substrate, wherein the front panel and the back panel are arranged so as to mutually face each other and a discharge space is formed by the front panel and the back panel being arranged so as to mutually face each other, wherein the first electrode and the dielectric layer include glass frit, the glass frit of the first electrode and the dielectric layer containing bismuth oxide, and a softening point higher than 550° C.;

wherein the second electrode includes glass frit, and a softening point of the glass frit contained in the second electrode is equal to or lower than the softening point of the glass frit contained in the first electrode, the method comprising:

forming a second electrode paste layer to be the second electrode;

forming a first electrode paste layer to be the first electrode;

forming a dielectric paste layer to be the dielectric layer; and collectively firing the second electrode paste layer, the first electrode paste layer, and the dielectric paste layer at a firing temperature from 550° C. to 600° C.

2. The method of manufacturing a plasma display panel of claim 1, wherein the plasma display panel further includes a black stripe formed on the front panel to block light, and wherein the collectively firing includes collectively firing the second electrode paste layer, the first electrode paste layer, the dielectric paste layer, and the black stripe.

* * * * *